US005596978A

United States Patent [19]

*Johnson et al.

[11] Patent Number: 5,596,978

[45] Date of Patent: Jan. 28, 1997

[54] RAPID FIRE COMPRESSED AIR GUN

[75] Inventors: Lonnie G. Johnson, Smyrna; John Applewhite, Atlanta, both of Ga.

[73] Assignee: Johnson Research & Development Co, Inc., Smyrna, Ga.

[ * ] Notice: The term of this patent shall not extend beyond the expiration date of Pat. No. 5,592,931.

[21] Appl. No.: 441,229

[22] Filed: May 15, 1995

[51] Int. Cl.[6] ..... F41B 11/02

[52] U.S. Cl. ..... 124/72; 124/63; 124/69; 124/53.5; 124/48

[58] Field of Search ..... 124/72, 63, 69, 124/53.5, 48; 446/212

[56] References Cited

U.S. PATENT DOCUMENTS

| | | | |
|---|---|---|---|
| 2,147,003 | 2/1939 | Kozurik | 124/72 |
| 2,312,244 | 2/1943 | Feltman | 124/72 |
| 2,357,951 | 9/1944 | Hale | 124/72 |
| 2,733,699 | 1/1952 | Krinsky | 124/13 |
| 2,927,398 | 3/1960 | Kaye et al. | 46/74 |
| 3,025,633 | 3/1962 | Kaye et al. | 46/74 |
| 3,049,832 | 8/1962 | Jaffe | 46/74 |
| 3,121,292 | 2/1964 | Butler et al. | 46/74 |
| 3,397,476 | 8/1968 | Weber | 124/72 X |
| 3,962,818 | 6/1976 | Pippin, Jr. | 46/74 |
| 4,073,280 | 2/1978 | Koehn et al. | 124/72 |
| 4,083,349 | 4/1978 | Clifford | 124/72 |
| 4,159,705 | 7/1979 | Jacoby | 124/63 |
| 4,223,472 | 9/1980 | Fekete et al. | 46/44 |
| 4,411,249 | 10/1983 | Fogarty et al. | 124/64 |
| 4,897,065 | 1/1990 | Fertig et al. | 446/63 |
| 5,188,557 | 2/1993 | Brown | 446/212 |
| 5,343,849 | 9/1994 | Steer | 124/69 X |
| 5,343,850 | 9/1994 | Steer | 124/59 X |
| 5,373,832 | 12/1994 | D'Andrade | 124/59 X |
| 5,415,152 | 5/1995 | Adamson et al. | 124/59 |

*Primary Examiner*—Terry Lee Melius
*Assistant Examiner*—Thomas A. Beach
*Attorney, Agent, or Firm*—Kennedy & Kennedy

[57] ABSTRACT

An air compressed gun (10) is provided having a stock (11), a barrel (12), a trigger (13) and a manual air pump (14). The gun also has a magazine (18) having a series of barrels (26) for holding several projectiles (P). An actuator (50) indexes the magazine with each shot of the gun and automatically actuates a release valve (36) which controls the firing of the gun.

34 Claims, 3 Drawing Sheets

RAPID FIRE COMPRESSED AIR GUN

TECHNICAL FIELD

This invention relates to compressed air guns, and specifically to compressed air toy guns which rapidly fire a sequence of projectiles.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. This type of gun uses a reciprocating air pump to pressurize air within a pressure tank. In use, the pump must be reciprocated several times with each firing of the gun. Therefore, a small child may become quite weary with extended use of the gun. Additionally, as the gun must be pumped with each firing it is not capable of firing several darts in rapid sequence. The rapid firing of a gun may be desired for those playing a mock war or other type of competition.

Accordingly, it is seen that a need remains for a toy air gun which may rapidly fire a sequence of projectiles. It is to the provision of such therefore that the present invention is primarily directed.

SUMMARY OF THE INVENTION

In a preferred form of the invention a rapid fire compressed air gun has a magazine in which a plurality of projectiles may be loaded, a pressure tank, and pump means for compressing air in the pressure tank. The gun has pneumatic indexing means for sequentially positioning projectiles in the magazine for firing, conduit means for conveying compressed air from the pressure tank to the magazine, and trigger means for controlling the flow of air from the pressure tank to the magazine and the pneumatic indexing means in launching the projectiles. So constructed, the gun may automatically index the magazine for rapidly firing projectiles in sequence.

In another preferred form of the invention a rapid fire compressed air gun has a pressure tank adapted to contain pressurized air, an air pump for pressurizing the pressure tank, and a magazine adapted to hold a plurality of projectiles. The gun has a pressure chamber in fluid communication with the pressure tank adapted to contain pressurized air, and pressure sensitive release valve means for controlling the release of pressurized air from the pressure chamber to the magazine. The gun also has pneumatic actuation means for fully automatic, sequential actuation of the pressure sensitive release valve means. Trigger means are provided for controlling the actuation means. So constructed, the gun may fire a series of projectiles in rapid succession without having to actuate the trigger or the pump between each successive firing.

DETAILED DESCRIPTION

Figure 1:
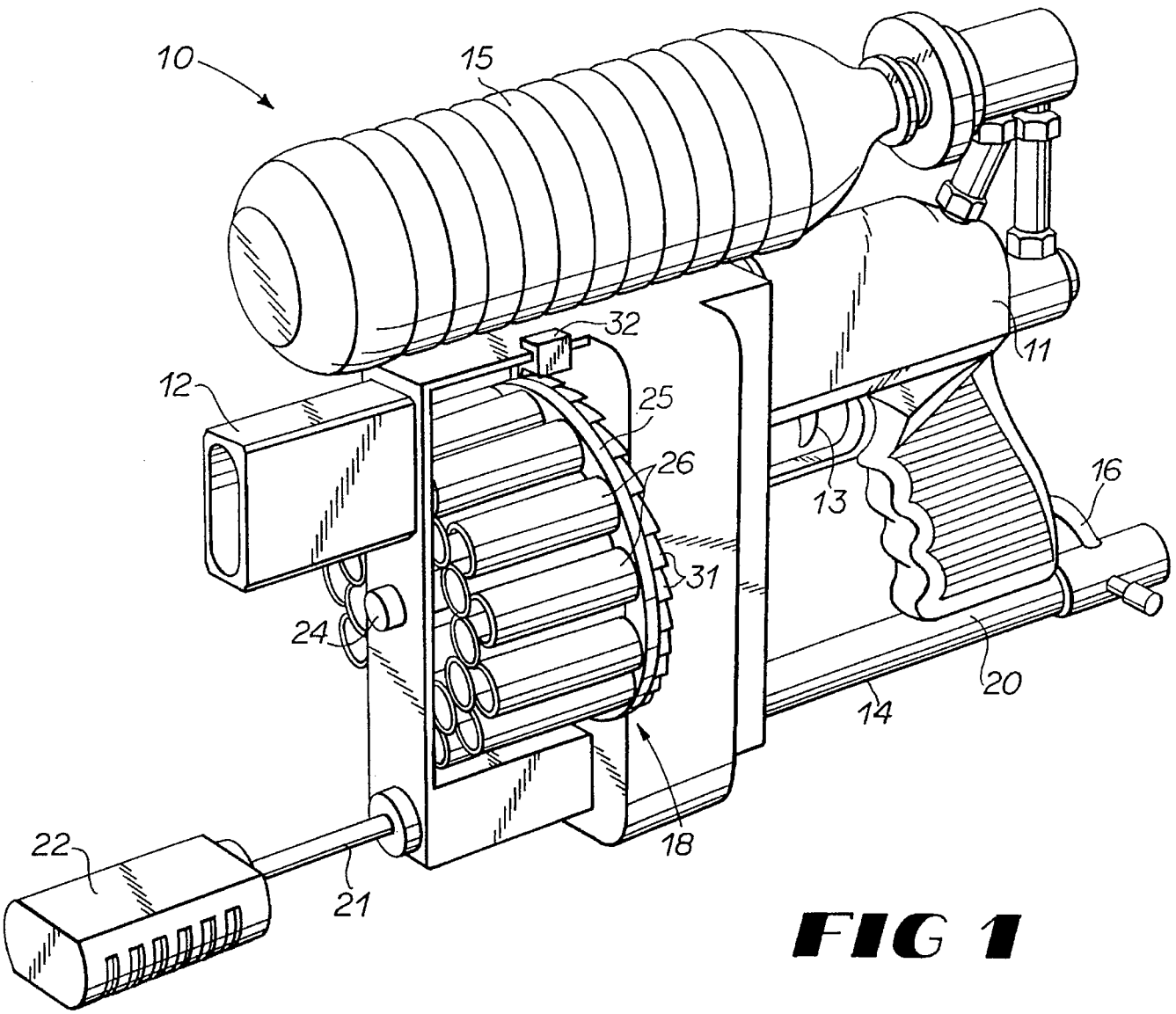
FIG. 1 is a perspective view of a rapid fire compressed air gun embodying principles of the present invention in a preferred form.

With reference next to the drawings, there is shown a compressed air gun 10 having a stock or handle 11, a barrel 12 mounted to the stock 11, a spring biased trigger 13, and a manual air pump 14. The gun 10 has a pressure tank 15 in fluid communication with the air pump 14 through a pressure tube 16 and a multi-projectile magazine 18 rotationally mounted to stock 11. The pump 14 includes a conventional cylinder 20, a cylinder rod 21 and a handle 22 mounted to an end of the cylinder rod 21.

Figure 2:
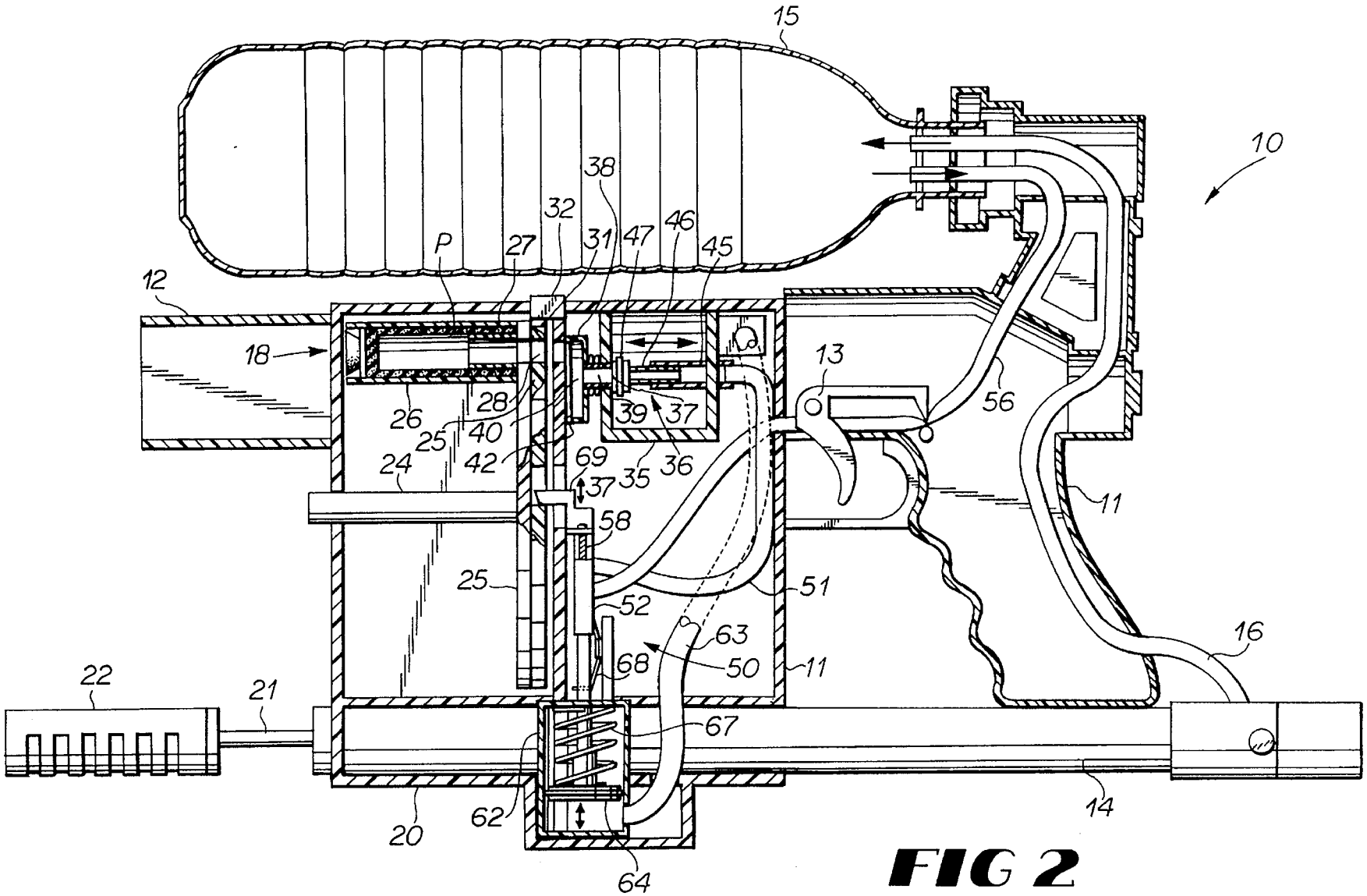
FIG. 2 is a side view, shown in partial cross-section, of the air gun of FIG. 1.

The magazine 18 has a central pivot rod 24 mounted to a disk-shaped mounting plate 25 and an annular array of projectile barrels 26 extending from the mounting plate 25 in generally two concentric circles about pivot rod 24. Each barrel 26 has a launch tube 27 therein aligned with an opening 28 extending through the mounting plate 25. The gun magazine is shown in FIG. 2 as having only one barrel for clarity of explanation. Mounting plate 25 has series of peripheral, outwardly extending, serrated teeth 31 each of which is aligned with a barrel 26. The serrated teeth 31 are configured to cooperate with a pawl 32 extending from the stock 11. The mounting plate 25 also has an annular array of L-shaped grooves 33 equal in number to the number of magazine barrels 26.

The gun 10 has a pressure chamber 35 adapted to receive and store a supply of air at elevated pressure levels and a pressure sensitive release valve 36 mounted within the pressure chamber 35. The pressure chamber 35 has an exit opening 37 therein. A spring biased sealing plate 38 is mounted within opening 37. The sealing plate 38 has a central bore 39 extending into an elongated bore 40 configured to overlay the mounting plate openings 28. It should be noted that the mounting plate openings 28 are positioned so that the sealing plate elongated bore 40 overlaps only one opening 28 at a time. A gasket 42 is mounted to the sealing plate 38 to ensure sealing engagement of the sealing plate with the mounting plate 25. The release valve 36 has a cylindrical manifold 45 and a cylindrical plunger 46 slidably mounted within manifold 45. Plunger 46 has a gasket 47 to ensure sealing engagement of the plunger about opening 37.

The release valve manifold 45 is pneumatically coupled to an actuator 50, by a pressure tube 51 extending therebetween the actuator 50 automatically and sequentially causes the actuation of the release valve 36. Actuator 50 includes an elongated manifold 52 having an upper opening 53 in fluid communication with pressure tube 51 and a lower opening 55 in fluid communication with another pressure tube 56 extending from the pressure tank 15 and positioned so as to be pinchably closed by spring biased trigger 13. A piston 58 is movably mounted within actuator manifold 52. Piston 58 has a top seal 59 and a bottom seal 60. The actuator 50 also has a pressure cylinder 62 having a vent 61 adjacent its top end. Pressure cylinder 62 is coupled in fluid communication with pressure chamber 35 by a pressure tube 63. A piston 64, having an elongated piston rod 65, is mounted within the actuator pressure cylinder 62 for reciprocal movement therein between a low pressure position shown in FIGS. 2 and 3 and a high pressure position shown in FIG. 4. A coil spring 67 mounted about piston rod 65 biases the piston 64 towards its low pressure position. Piston rod 65 is coupled to piston 58 by an over center torsion spring 68, such as that made by Barnes Group Incorporated of Corry, Pa. under model number T038180218-R. An indexing finger 69, mounted to an end of the piston rod 65, is configured to sequentially engage and ride within each magazine L-shaped groove 33.

In use, an operator actuates the pump to pressurize a supply of air by grasping the handle 22 and reciprocating the cylinder rod 21 back and forth within the cylinder 20. Pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 52 between the top and bottom seals 59 and 60. The pressurized air then passes out of lower opening 55 and through pressure tube 51 into release valve manifold 45.

Figure 3:
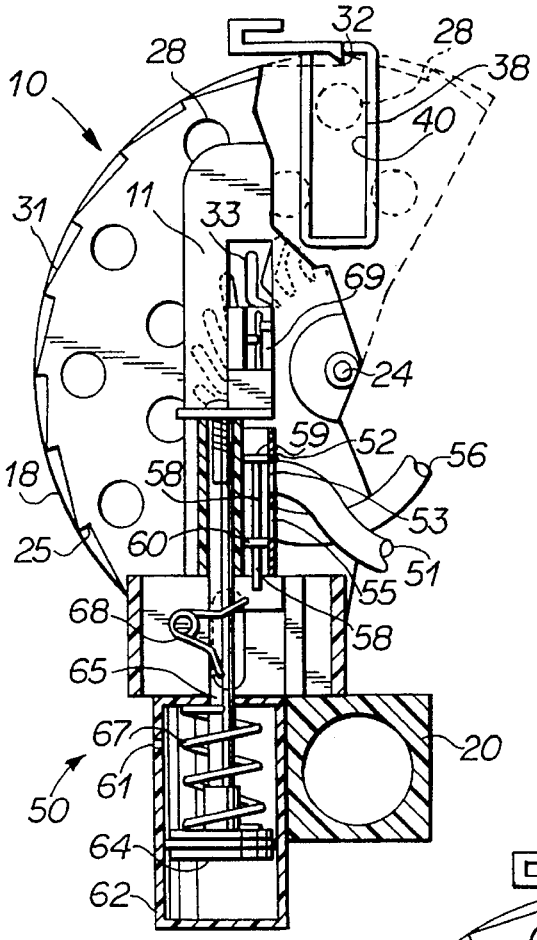
FIGS. 3–5 are a sequence of views showing a portion of the air gun of FIG. 1, which show in sequence, the actuation of an actuator which indexes a magazine and controls a release valve.
Figure 4:
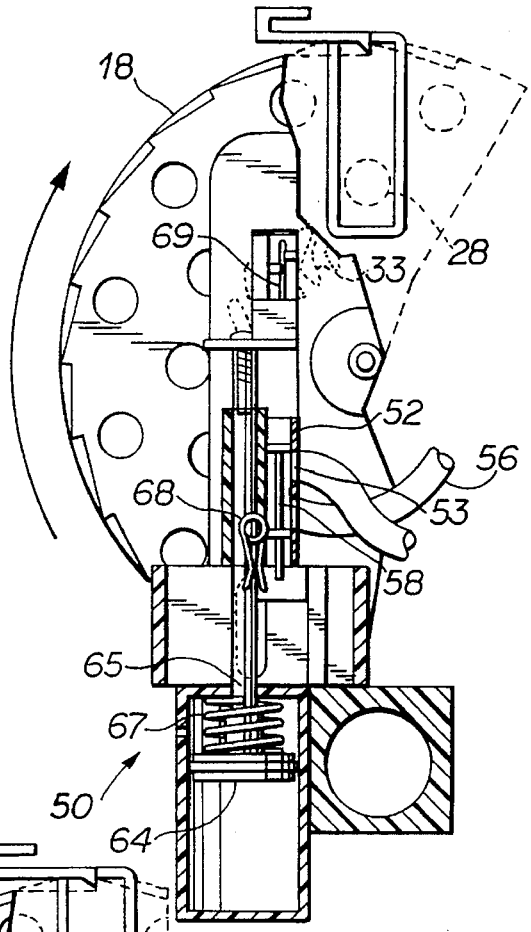
Figure 5:
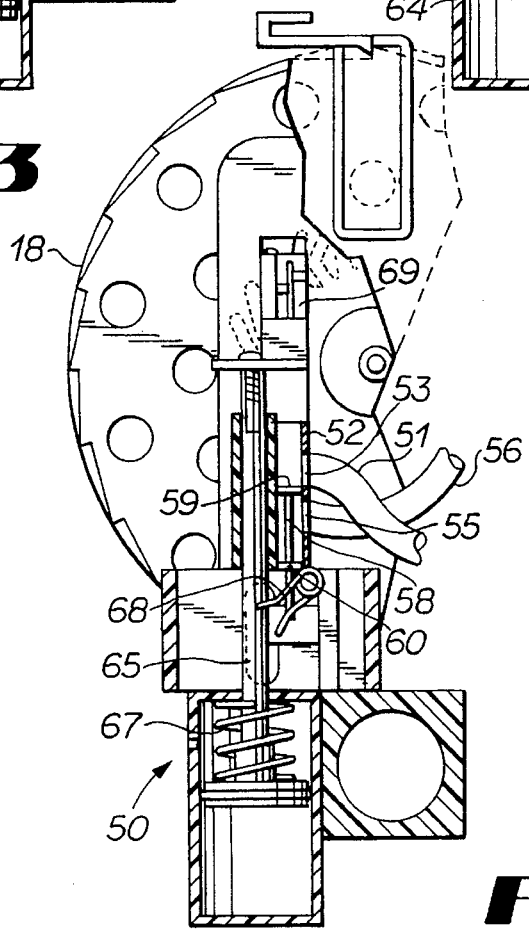

The pressurized air within the release valve manifold 45 causes the plunger 46 to move to a forward position sealing the opening 37. Pressurized air then flows between the plunger 46 and the release valve manifold 45 so as to pressurize the pressure chamber 35. A portion of the pressurized air within pressure chamber 35 passes through pressure tube 63 into the actuator pressure cylinder 62. With increased pressure within pressure cylinder 62 the piston 64 is forced upwards against the biasing force of coil spring 67, i.e. the piston 64 is moved from its low pressure position shown in FIG. 3 to its high pressure position shown in FIG. 4. As shown in FIG. 4, upward movement of the piston rod 65 causes compression of torsion spring 68 and the finger 69 to ride up within a mounting plate groove 33 thereby causing clockwise rotation of the magazine 18. All references herein to downward and upward directions is for purposes of clarity in reference to the drawings and is not meant to indicate gravity sensitivity. Upon reaching the apex of the movement of piston rod 65 the torsion spring 68 decompresses thereby forcing piston 58 downward, as shown in FIG. 5. Downward movement of piston 58 causes the top seal 59 to be positioned between upper opening 53 and lower opening 55. This positioning of the piston 58 isolates manifold lower opening 55 to prevent escape of pressurized air from pressure tank 15. This positioning of the top seal 59 also allows pressurized air within pressure tube 51 to escape to ambience through the top of actuator manifold 52. The release of air pressure causes the plunger 46 to move to a rearward position unsealing opening 37. With the unsealing of opening 37 pressurized air within pressure chamber 35 flows through opening 37, into the central and elongated bores 39 and 40 of sealing plate 38, and into the launch tube 27 through mounting plate opening 28. Pressurized air within launch tube 27 propels the projectile out of the magazine barrel 26 and through gun barrel 12. The actuation of this type of release valve is described in more detail in U.S. Pat. No. 4,159,705.

Upon the release of pressurized air from pressure chamber 35 the pressurized air within pressure cylinder 62 is released through pressure tube 63 back into pressure chamber 35. The release of air from pressure cylinder 62 causes the piston 64 to be spring biased by coil spring 67 back downward to its low pressure position. The downward movement of piston 64 retracts the indexing finger 69 from within a mounting plate groove 33 and positions the finger in register with the following mounting plate groove 33. The low pressure positioning of piston 64 causes the torsion spring 68 to bias piston 58 upwards to its initial position with the top and bottom seals 59 and 60 straddling upper and lower openings 53 and 55, as shown in FIG. 3. This repositioning of piston 58 once again causes pressurized air within pressure tank 15 to flow through pressure tube 56 into actuator manifold 52, thereby just describe may continue in rapid sequence so long as the trigger is maintained in a position allowing the flow of pressurized air through pressure tube 56 and the pressure tank continues to contains a minimal level of pressurized air sufficient to overcome the biasing force of springs 67 and 68, i.e. the release valve is automatically actuated by actuator 50 and the indexing of magazine 18 continues so long as the trigger is pulled open and the pressure tank contains pressurized air above a level to overcome springs 67 and 68. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 50. Operated in such a manner the gun will index the magazine and fire a projectile with each actuation of the trigger, again, so long as the pressure tank contains air pressurized above the minimal level and the trigger is quickly released.

It should be noted that pawl 32 engages teeth 31 to prevent rotation of the magazine in a direction opposite to its indexing direction, i.e. to prevent counterclockwise rotation in FIG. 3. This prevents the firing of pressurized air into a just emptied barrel and damage to the indexing finger. It should also be noted that since the pneumatic system is closed, once the gun is initially pressurized it is maintained under at least the minimal pressure level. Thus, the gun has the capability of firing projectiles in a rapid sequence of shots one after another. Yet, the gun may also fire a sequence of single shots without having to be pumped between each successive shot.

While this invention has been described in detail with particular reference to the preferred embodiment thereof, it should be understood that many modifications, additions and deletions, may be made thereto without departure from the spirit and scope of invention as set forth in the following claims.

We claim:

1. A rapid fire compressed air gun comprising:

a magazine in which a plurality of projectiles may be loaded;

a pressure tank;

pump means for compressing air in said pressure tank;

pneumatic indexing means for sequentially positioning projectiles in said magazine for firing;

conduit means for conveying compressed air from said pressure tank to said magazine and to said pneumatic indexing means; and trigger means for controlling the flow of pressurized air from said pressure tank to said magazine and to said pneumatic indexing means, said pneumatic indexing means includes a manifold in fluid communication with said pressure tank, a piston positioned within said manifold for reciprocal movement between a first position and a second position, biasing means for biasing said piston toward said first position, and wherein said conduit means includes a conduit for conveying pressurized air from said pressure tank to said manifold for use in pneumatically biasing said piston toward said second position, and coupling means for coupling said piston to said magazine.

2. The rapid fire compressed air gun claim 1 wherein said coupling means includes an array of grooves upon said magazine and a finger configured to sequentially ride within said grooves.

3. The rapid fire compressed air gun of claim 1 wherein said trigger means includes release valve means for controlling the release of pressurized air from said pressure tank to said magazine.

4. A rapid fire compressed air gun comprising:

a magazine in which a plurality of projectiles may be loaded;

a pressure tank;

pump means for compressing air in said pressure tank;

pneumatic indexing means for sequentially positioning projectiles in said magazine for firing;

conduit means for conveying compressed air from said pressure tank to said magazine and to said pneumatic indexing means;

trigger means for controlling the flow of pressurized air from said pressure tank to said magazine and to said pneumatic indexing means;

release valve means for controlling the release of pressurized air from said pressure tank to said magazine; and pneumatic actuation means for fully automatic sequential actuation of said release valve means.

5. The rapid fire compressed air gun of claim 4 wherein said actuation means comprises a first manifold having a first and second opening therein, a first conduit extending from said first opening of said manifold to said pressure tank, a second conduit extending from said second opening of said manifold to said release valve means, a piston having a first seal and a second seal spaced from said first seal, said piston being movably mounted within said first manifold for reciprocal movement between a pressuring position with said first and second seals straddling said manifold first and second opening and a releasing position with said first seal positioned between said manifold first and second opening, whereby with the piston in its pressuring position pressurized air within the pressure tank is passed through the first conduit into the manifold through the first opening, out of the manifold through said second opening and into said second conduit, through said second conduit to the release valve means and the pressure chamber for pressurization thereof, and with the piston in its releasing position pressurized air within the first conduit is released therefrom to actuate the release valve means.

6. The rapid fire compressed air gun of claim 5 wherein said actuation means further comprises a second manifold in fluid communication with said pressure chamber, a second piston positioned within said second manifold for reciprocal movement between a first pressure position and a second pressure position, said second piston being coupled to said first piston, and biasing means for biasing said piston toward said first pressure position.

7. A rapid fire compressed air gun comprising:

a pressure tank adapted to contain pressurized air;

air pump means for pressurizing said pressure tank;

a magazine adapted to hold a plurality of projectiles;

a pressure chamber in fluid communication with said pressure tank and with said magazine, and adapted to contain pressurized air;

pressure sensitive release valve means for controlling the release of pressurized air from said pressure chamber to said magazine;

pneumatic actuation means for fully automatic sequential actuation of said pressure sensitive release valve means; and trigger means for controlling said actuation means.

8. The rapid fire compressed air gun of claim 7 further comprising indexing means for sequentially indexing said magazine in registered positions with said pressure chamber.

9. The rapid fire compressed air gun of claim 7 wherein said actuation means is operated by pressurized air from said pressure tank.

10. The rapid fire compressed air gun of claim 7 further comprising sealing means between said pressure chamber and said magazine for creating a sealed path therebetween.

11. The rapid fire compressed air gun of claim 10 wherein said sealing means comprises a movable plate having a opening therethrough and a spring biasing said plate toward said magazine.

12. The rapid fire compressed air gun of claim 7 wherein said magazine comprises a radial array of launch tubes.

13. The rapid fire compressed air gun of claim 12 further comprising indexing means for rotationally indexing said magazine in sequence to registered positions with said pressure chamber.

14. The rapid fire compressed air gun of claim 7 wherein said actuation means comprises a first manifold having a first and second opening therein, a first conduit extending from said first opening of said manifold to said pressure tank, a second conduit extending from said second opening of said manifold to said release valve means, a piston having a first seal and a second seal spaced from said first seal, said piston being movably mounted within said first manifold for reciprocal movement between a pressuring position with said first and second seals straddling said manifold first and second opening and a releasing position with said first seal positioned between said manifold first and second opening, whereby with the piston in its pressuring position pressurized air within the pressure tank is passed through the first conduit into the manifold through the first opening, out of the manifold through said second opening and into said second conduit, through said second conduit to the release valve means and the pressure chamber for pressurization thereof, and with the piston in its releasing position pressurized air within the first conduit is released therefrom to actuate the release valve means.

15. The rapid fire compressed air gun of claim 14 wherein said actuation means further comprises a second manifold in fluid communication with said pressure chamber, a second piston positioned within said second manifold for reciprocal movement between a first pressure position and a second pressure position, said second piston being coupled to said first piston, and biasing means for biasing said piston toward said first pressure position.

16. The rapid fire compressed air gun of claim 13 wherein said magazine has a radial array of grooves and said indexing means includes a finger adapted for reciprocal movement and configured to ride within said grooves.

17. The rapid fire compressed air gun of claim 13 wherein said magazine has a radial array of grooves and said indexing means includes a finger coupled to said second piston configured to ride within said grooves.

18. A compressed air gun comprising, pump means for pressurizing a supply of air;

a pressure tank coupled to pump means;

a magazine adapted to hold a plurality of projectiles;

conduit means for conveying pressurized air from said pressure tank to said magazine;

release valve means for releasing bursts of pressurized air from said pressure tank to said magazine;

a trigger; and means for the automatic and sequential actuation of said release valve means in response to actuation of said trigger, said actuation means is operated by pressurized air from said pressure tank.

19. The compressed air gun of claim 18 further comprising a pressure chamber in fluid communication with said pressure tank and said release valve means.

20. The compressed air gun of claim 18 further comprising indexing means for sequentially indexing said magazine in registered positions with said pressure chamber.

21. The compressed air gun of claim 18 further comprising sealing means positioned between said release valve means and said magazine for creating a sealed path therebetween.

22. The compressed air gun of claim 18 wherein said magazine comprises a radial array of launch tubes.

23. The compressed air gun of claim 18 further comprising indexing means for rotationally indexing said magazine in sequence to registered positions for firing.

24. A compressed air gun comprising, pump means for pressurizing a supply of air;

a pressure tank coupled to said pump means;

a magazine adapted to hold a plurality of projectiles;

conduit means for conveying pressurized air from said pressure tank to said magazine;

release valve means for releasing bursts of pressurized air from said pressure tank to said magazine;

a trigger;

means for the automatic and sequential actuation of said release valve means in response to actuation of said trigger, and sealing means positioned between said release valve means and said magazine for creating a sealed path therebetween, said sealing means comprises a movable plate having an opening therethrough and a spring biasing said plate toward said magazine.

25. A compressed air gun comprising, pump means for pressurizing a supply of air;

a pressure tank coupled to pump means;

a magazine adapted to hold a plurality of projectiles;

conduit means for conveying pressurized air from said pressure tank to said magazine;

release valve means for releasing bursts of pressurized air from said pressure tank to said magazine;

a trigger; and means for the automatic and sequential actuation of said release valve means in response to actuation of said trigger, said actuation means comprises a first manifold having a first and second opening therein, a first conduit extending from said first opening of said manifold to said pressure tank, a second conduit extending from said second opening of said manifold to said release valve means, a piston having a first seal and a second seal spaced from said first seal, said piston being movably mounted within said first manifold for reciprocal movement between a pressuring position with said first and second seals straddling said manifold first and second opening and a releasing position with said first seal positioned between said manifold first and second opening, whereby with the piston in its pressuring position pressurized air within the pressure tank is passed through the first conduit into the manifold through the first opening, out of the manifold through said second opening and into said second conduit, through said second conduit to the release valve means, and with the piston in its releasing position pressurized air within the first conduit is released therefrom to actuate the release valve means.

26. The compressed air gun of claim 25 wherein said actuation means further comprises a second manifold in fluid communication with said release valve means, a second piston positioned within said second manifold for reciprocal movement between a first pressure position and a second pressure position, said second piston being coupled to said first piston, and biasing means for biasing said piston toward said first pressure position.

27. The compressed air gun of claim 26 wherein said magazine has a radial array of grooves and said indexing means includes a finger coupled to said second piston configured to ride within said grooves.

28. A compressed air gun comprising, pump means for pressurizing a supply of air;

a pressure tank coupled to pump means;

a magazine adapted to hold a plurality of projectiles, said magazine having a radial array of launch tubes and a radial array of grooves;

conduit means for conveying pressurized air from said pressure tank to said magazine;

release valve means for releasing bursts of pressurized air from said pressure tank to said magazine;

a trigger;

means for the automatic and sequential actuation of said release valve means in response to actuation of said trigger;

indexing means for rotationally indexing said magazine in sequence to registered positions for firing, said indexing means including a finger coupled to said second piston configured to ride within said grooves.

29. A compressed air gun comprising:

a pressure tank;

an air pump for pressurizing air within said pressure tank;

a release valve for releasing pressurized air from said pressure tank;

a magazine adapted to hold a plurality of projectiles; and actuation means for fully automatic sequential actuation of said release valve, said actuation means having a first manifold having a first and second opening therein, a first conduit extending from said first opening of said manifold to the pressure tank, a second conduit extending from said second opening of said manifold to the release valve means, a piston having a first seal and a second seal spaced from said first seal, said piston being movably mounted within said first manifold for reciprocal movement between a pressuring position with said first and second seals straddling said manifold first and second opening and a releasing position with said first seal positioned between said manifold first and second opening, whereby with the piston in its pressuring position pressurized air within the pressure tank is passed through the first conduit into the manifold through the first opening, out of the manifold through said second opening and into said second conduit, through said second conduit to the release valve means, and with the piston in its releasing position pressurized air within the first conduit is released therefrom to actuate the release valve means.

30. The compressed air gun of claim 29 wherein said actuation means further comprises a second manifold in fluid communication with said pressure tank, a second piston positioned within said second manifold for reciprocal movement between a first pressure position and a second pressure position, said second piston being coupled to said first piston, and biasing means for biasing said piston toward said first pressure position.

31. The compressed air gun of claim 30 further comprising indexing means for sequentially indexing said magazine to a firing station.

32. The compressed air gun of claim 31 wherein said magazine has an array of grooves and said indexing means includes a finger coupled to said second piston configured to ride within said grooves.

33. In a compressed air gun of the type having a pressure tank, an air pump for pressurizing air within the pressure tank, and a release valve for releasing pressurized air within the pressure tank, and a magazine having a plurality of barrels each adapted to hold a projectile for firing, the improvement comprising:

pneumatic indexing means for sequentially indexing said magazine in a series of positions with the magazine barrels in fluid communication with the pressure tank so the release of pressurized air from the pressure tank launches projectiles from the magazine barrel, said indexing means includes a manifold in fluid communication with said pressure tank, a piston positioned within said manifold for reciprocal movement between a first position and a second position, biasing means for biasing said piston toward said first position, conduit means for conveying pressurized air from said pressure tank to said manifold so as to pneumatically bias said piston toward said second position, and coupling means for coupling said piston to said magazine.

34. The compressed air gun of claim 33 wherein said coupling means includes an array of grooves upon said magazine and a finger configured to sequentially ride within said grooves.

* * * * *